US009238879B2

(12) United States Patent
Moon et al.

(10) Patent No.: US 9,238,879 B2
(45) Date of Patent: Jan. 19, 2016

(54) METHOD OF FABRICATING THERMAL CONDUCTIVE POLYMER

(71) Applicant: SK INNOVATION CO., LTD., Seoul (KR)

(72) Inventors: Yongrak Moon, Daejeon (KR); Kangmin Jung, Daejeon (KR)

(73) Assignee: SK INNOVATION CO., LTD., Seoul (KR)

( * ) Notice: Subject to any disclaimer, the term of this patent is extended or adjusted under 35 U.S.C. 154(b) by 0 days.

(21) Appl. No.: 14/527,426

(22) Filed: Oct. 29, 2014

(65) Prior Publication Data

US 2015/0119545 A1 Apr. 30, 2015

(30) Foreign Application Priority Data

Oct. 30, 2013 (KR) ..... 10-2013-0129871

(51) Int. Cl.

| | |
|---|---|
| ***D01F 11/06*** | (2006.01) |
| ***D01D 5/06*** | (2006.01) |
| ***D01F 6/04*** | (2006.01) |
| ***D01D 5/16*** | (2006.01) |
| *D01F 6/46* | (2006.01) |

(52) U.S. Cl.

CPC .. *D01F 6/04* (2013.01); *D01D 5/16* (2013.01); *D01F 6/46* (2013.01); *D10B 2321/0211* (2013.01)

(58) Field of Classification Search

CPC ..... D01F 11/06; D01D 5/06

See application file for complete search history.

(56) References Cited

U.S. PATENT DOCUMENTS

| | | | | |
|---|---|---|---|---|
| 5,198,280 | A * | 3/1993 | Harpell | F41H 1/02 428/102 |
| 5,591,933 | A * | 1/1997 | Li | F41H 5/0485 156/93 |
| 7,964,518 | B1 * | 6/2011 | Bhatnagar | B32B 5/26 2/2.5 |

* cited by examiner

*Primary Examiner* — Robert Harlan

(74) *Attorney, Agent, or Firm* — Hauptman Ham, LLP

(57) ABSTRACT

Provided is a method of fabricating a thermal conductive polymer, including: a) fabricating a gel filament by primarily elongating a solution filament formed by spinning a mixed solution containing an ultra high molecular weight polyolefin (UHMWPO) resin and a first solvent, followed by cooling; b) secondarily elongating the gel filament; c) fabricating a dry filament by removing the solvent from the gel filament, followed by tertiary elongation; and d) converting the dry filament into the gel filament by adding the first solvent to the dry filament; e) removing the first solvent from the converted gel filament; and f) quaternarily elongating the gel filament from which the first solvent is removed.

20 Claims, 2 Drawing Sheets

METHOD OF FABRICATING THERMAL CONDUCTIVE POLYMER

CROSS-REFERENCE TO RELATED APPLICATIONS

This application claims priority under 35 U.S.C. §119 to Korean Patent Application No. 10-2013-0129871, filed on Oct. 30, 2013, in the Korean Intellectual Property Office, the disclosure of which is incorporated herein by reference in its entirety.

TECHNICAL FIELD

The following disclosure relates to a method of fabricating a thermal conductive polymer and a thermal conductive polymer fabricated therefrom.

BACKGROUND

In a thermoplastic resin composition, the resin has lower thermal conductivity at the time of being applied to various fields such as cases of personal computers or displays, or materials of electronic devices, interior or exterior materials of automobiles, and the like, as compared to inorganic materials such as a metal material, and the like, such that it is difficult to emit or transfer heat to be generated, thereby having a limitation in being used. Accordingly, an effort to obtain a highly thermal conductive resin composition by filling the thermoplastic resin composition with a large amount of highly thermal conductive inorganic material as a filler has been widely attempted.

Examples of the highly thermal conductive inorganic compound as the filler include graphite, carbon fiber, a low melting point metal, alumina, aluminum nitride, and the like, and it is required to mix the highly thermal conductive filler at a large amount into a resin within a range at which physical properties of the resin are not deteriorated.

Meanwhile, the thermoplastic resin composition containing the large amount of the highly thermal conductive filler may have significantly decreased injection moldability due to the filler, in addition to deteriorated molding workability and product quality due to mold contamination including bleed-out, and the like.

That is, since the resin containing the large amount of the highly thermal conductive filler mixed thereinto has deteriorated molding workability and physical properties, a research into a more effective thermal conductive filler mixed into the resin has been conducted in order to decrease the content of highly thermal conductive filler.

SUMMARY

An embodiment of the present invention is directed to providing a method of fabricating a thermal conductive polymer capable of improving thermal conductivity without adding a thermal conductive filler, and having a simplified fabrication process and excellent production efficiency to maximize productivity, thereby providing excellent economical feasibility, and a thermal conductive polymer fabricated by the method.

In one general aspect, there is provided a method of fabricating a thermal conductive polymer including: a) fabricating a gel filament by primarily elongating a solution filament formed by spinning a mixed solution containing an ultra high molecular weight polyolefin (UHMWPO) resin and a first solvent, followed by cooling; b) secondarily elongating the gel filament; c) fabricating a dry filament by removing the solvent from the gel filament, followed by tertiary elongation; and d) converting the dry filament into a gel filament by adding the first solvent to the dry filament; e) removing the first solvent from the converted gel filament; and f) quaternarily elongating the gel filament from which the first solvent is removed.

In another general aspect, there is provided a thermal conductive polymer fabricated by the method as described above, wherein the thermal conductive has a degree of crystallization of 80 to 95%, and a dichroic ratio of 1 to 10.

DETAILED DESCRIPTION OF MAIN ELEMENTS

Figure 1:
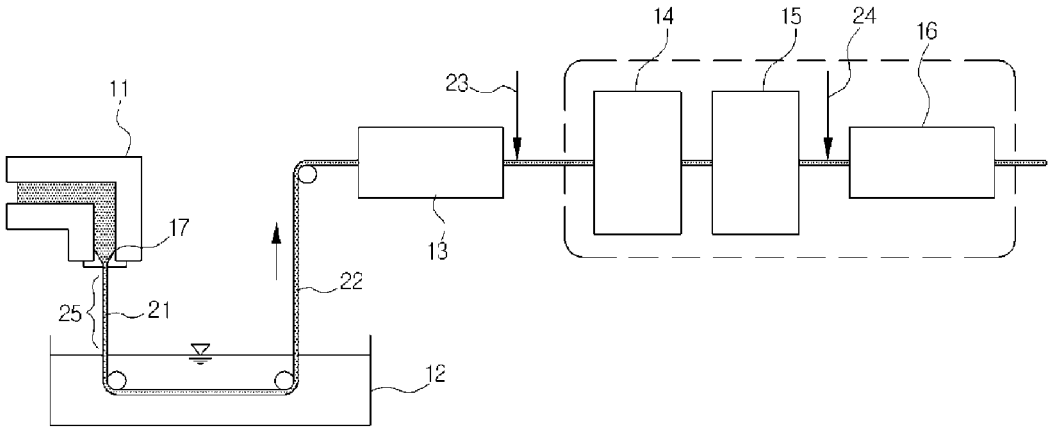
FIG. 1 is a schematic diagram showing an embodiment of a method of fabricating a thermal conductive polymer according to an exemplary embodiment of the present invention.

11: EXTRUDER
12: WATER BATH
13: FIRST OVEN
14: FIRST SOLVENT REACTOR
15: FIRST SOLVENT REACTOR
16: SECOND OVEN
17: SPINNERET
21: SOLUTION FILAMENT
22: GEL FILAMENT
23: DRY FILAMENT
24: GEL FILAMENT
25: AIR GAP

DETAILED DESCRIPTION OF EMBODIMENTS

Hereinafter, a method of fabricating a thermal conductive polymer according to the present invention is described in detail. Examples and drawings to be described below are provided by way of example so that the idea of the present invention can be sufficiently transferred to those skilled in the art to which the present invention pertains. Meanwhile, unless technical and scientific terms used herein are defined otherwise, they have meanings understood by those skilled in the art to which the present invention pertains. Descriptions of known functions and components will be omitted so as not to obscure the gist of the present invention with unnecessary detail.

The method of fabricating a thermal conductive polymer according to the present invention includes: a) fabricating a gel filament by primarily elongating a solution filament formed by spinning a mixed solution containing an ultra high molecular weight polyolefin (UHMWPO) resin and a first solvent, followed by cooling; b) secondarily elongating the gel filament; c) fabricating a dry filament by removing the solvent from the gel filament, followed by tertiary elongation; d) converting the dry filament into the gel filament by adding the first solvent to the dry filament; e) removing the first solvent from the converted gel filament; and f) quaternarily elongating the gel filament from which the first solvent is removed.

The ultra high molecular weight polyolefin (UHMWPO) may have a weight average molecular weight of 3,500,000 g/mol to 10,500,000 g/mol, and an absolute viscosity of 5 to 45 dl/g. The ultra high molecular weight polyolefin (UHMWPO) satisfying the above-described range may increase a degree of crystallization without deteriorating workability.

The UHMWPO may be preferably an ultra high molecular weight polyethylene (UHMW PE).

In addition, in addition to the UHMWPO, any one or two or more highly crystalline resin(s) selected from the group consisting of polyethylene terephthalate (PET), polyoxymethylene (POM), nylon, polytetrafluoroethylene (PTFE) and polyphenylene sulfide (PPS) may be included.

In step a) of the present invention, the mixed solution is fabricated by mixing the UHMWPO resin with the first solvent. Here, the first solvent is used to dilute the ultra high molecular weight polyolefin, and examples of the first solvent may include aliphatic hydrocarbon-based solvents such as n-nonane, n-decane, n-undecane, n-dodecane, n-tetradecane, n-octadecane, liquid phase paraffin, kerosene (lamp oil), and the like; aromatic hydrocarbon-based solvents such as xylene, naphthalene, tetralin, butylbenzene, p-cymene, cyclohexyl benzene, diethyl benzene, pentyl benzene, dodecylbenzene, bicyclohexyl, decalin, methylnaphthalene, ethylnaphthalene, and the like, and hydrogenated derivatives thereof; halogenated hydrocarbon solvents such as 1,1,2,2-tetrachloroethane, pentachloroethane, hexachloroethane, 1,2,3-trichloropropane, dichlorobenzene, 1,2,4,-trichlorobenzene and bromobenzene, and the like; and aliphatic hydrocarbon compounds such as paraffin-based process oil, naphthene-based process oil, aromatic process oil, and the like, as mineral oils or waxes, and derivatives thereof, and the like. Preferably, the first solvent may be any one selected from the group consisting of a mineral oil, decalin, tetralin, xylene, toluene, dodecane, undecane, nonane, octene, polyethylene wax and mixtures thereof.

The mixed solvent of step a) may be obtained by dissolving a mixture at 120 to 160° C., and the polyolefin has a concentration of 30 to 80 wt %. In the above-described range, a product yield may be increased and workability may be improved to maximize productivity.

In step a) of the present invention, the gel filament may be fabricated by primarily elongating the solution filament formed by spinning the mixed solvent by a spinneret. Here, an elongation ratio may be 1 to 10. The elongation ratio ($V/V_0$) is a ratio of a draw-off speed (V) of a solidified non-stretched fiber to an extrusion speed ($V_0$) of the resin. When the elongation ratio is out of the range, it is difficult to gradually perform the elongation process in stages due to excessive molecular orientation, and thus, physical properties may be deteriorated. Here, the primary elongation is achieved by an individual elongation which is applied to solution spinning, which may maximize subsequent additional elongation effect by elongation of the solution filament (solution fiber), which is easy to be elongated.

The cooling in step a) may preferably be performed at 30 to 80° C., and may convert the solution filament into the gel filament. Here, when the cooling is performed out of the range, the solution filament is rapidly cooled, such that it is difficult to gradually perform the elongation process in stages. A water bath including a coolant may be provided in order to perform the cooling process; however, the present invention is not necessarily limited thereto.

In step b) of the present invention, the gel filament may be secondarily elongated. The second elongation is preferably performed at a ratio of 1.1:1 to 40:1, and when the second elongation is performed out of the range, the orientation of a polymer chain may be interrupted which causes deterioration in the degree of crystallization. Here, in the second elongation, molecular orientation may be affected by a molecular structure and crystallizability of the resin, and when two-stages or more of the elongation process is performed at the elongation ratio having the range, the molecular orientation of the gel filament may be stably increased.

The secondarily elongated gel filament in step c) of the present invention may be subjected to tertiary elongation at a temperature of 90 to 130° C., thereby fabricating the dry filament. Here, the tertiary elongation process may be performed at an elongation ratio of 1.1:1 to 10:1. In addition, the tertiary elongation process may be performed in an oven having an inert gas atmosphere, and preferably, pressure may be higher than atmospheric pressure so as to prevent air and oxygen from being permeated.

In step d) of the present invention, the dry filament may be converted into the gel filament by adding the first solvent to the dry filament fabricated by step c). In the converting of the dry filament into the gel filament, additional elongation process may be performed to improve orientation, thereby increasing the degree of crystallization.

Then, in step e) of the present invention, the first solvent is removed from the converted gel filament of step d). In step e), the first solvent having a high boiling point may be effectively removed by adding a second solvent, and preferably, the second solvent may be at least any one selected from hydrocarbon solvents having a boiling point of 40 to 80° C.

Examples of the process of removing the first solvent by using the second solvent may include without limitation at least any one method selected from a method of immersing the filament in a container containing the second solvent, a method of spraying the second solvent, a method of flowing the second solvent being a gaseous fluid or a supercritical fluid under an inert gas atmosphere, and a deposition method using steam.

In step f) of the present invention, the gel filament from which the first solvent is removed may be subjected to quaternary elongation. Here, the quaternary elongation process may be performed simultaneously or subsequently with the removing of the second solvent used for removing the first solvent. Step f) of the present invention may be preferably performed at a temperature range of 90 to 130° C. Here, the tertiary elongation process may be performed at an elongation ratio of 1.1:1 to 10:1. This process may be performed in an oven having an inert gas atmosphere, and pressure may be higher than atmospheric pressure so as to prevent air and oxygen from being permeated. In addition, two or more ovens are provided and the elongation process in stages is gradually performed, such that deterioration of an improvement effect of the degree of orientation of the polymer chain, caused by rapid elongation may be prevented, and an effect of the filament elongation and the degree of crystallization of filament may be maximized.

The elongation process in stages of the filament according to the present invention may improve the degree of orientation of the polymer chain to maximize the degree of crystallization, and therefore, thermal conductivity of the polymer may be remarkably improved. In particular, the gel filament tends to contract after the elongation, and at the time of contraction, the oriented polymer chain may be returned back to the original state. Accordingly, the elongation process in stages including the repeated elongation and cooling processes of the present invention is performed to minimize the contraction of the filament due to the elongation, such that the degree of orientation of the polymer chain may be maximized. The process may prevent the deterioration of the degree of orientation of the polymer chain caused by the rapid elongation.

Figure 3:
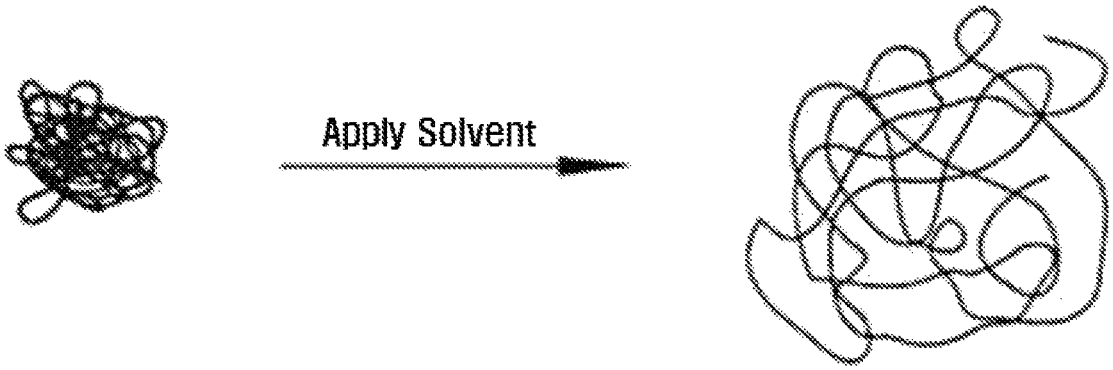
FIG. 3 schematically shows elongation or contraction of the polymer chain by applying the polymer to a solvent according to an exemplary embodiment of the present invention.

In addition, flowability of the polymer chain may be increased by applying the solvent to the filament or applying heat over a glass transition temperature. As shown in FIG. 3, the flowability of the polymer chain may be increased by applying the solvent to the filament according to the present invention (applying the solvent), which maximizes the degree of orientation of the polymer chain by the combination with the above-described elongation process in stages.

The present invention provides a thermal conductive polymer in which a degree of crystallization is 80 to 95%, and a dichroic ratio is 1 to 10, fabricated by the method of the present invention as described above.

FIG. 1 is a schematic diagram showing an embodiment of the method of fabricating the thermal conductive polymer according to the exemplary embodiment of the present invention, wherein an ultra high molecular weight polyethylene (UHMW PE) resin and the first solvent were supplied to an extruder 11, and the supplied materials were mixed and dissolved to fabricate the mixed solution. The extruder 11 is preferably a twin screw extruder. The fabricated mixed solvent is spinned by a spinneret 17 positioned at an exit of the extruder to form a solution filament (fluid fiber) 21. Here, the mixed solvent is preferably discharged through the spinneret 17 at 120 to 140° C. In addition, as needed, one or a plurality of the solution filament(s) 21 may be formed, wherein the filament used herein means a plurality of filaments, or one yarn, for convenience.

The solution filament 21 is primarily elongated, and cooled at a temperature range of 30 to 80° C. in a water bath 12 to be converted into a gel filament 22. The primary elongation process may be performed at an elongation ratio of 1 to 10. The coolant capable of cooling the solution filament 21 in the water bath 12 is preferably a cold solution of ethylene glycol in water. Here, the solution filament 21 before being converted may include a cone angle in the spinneret 17 and an air gap 25 between the spinneret 17 and the water bath 12, and the elongation of the filament is performed by changing speed of rolls positioned at the front and the rear. For example, when the rotation speed of the roll positioned at the rear is 10 times higher than that of the roll positioned at the front, the elongation process is performed at a ratio of 10:1.

The gel filament 22 may be oriented by performing the secondary elongation simultaneously with the partial removal of the first solvent while passing through the over and under rolls in a first oven 13 at a gradually increased speed. Here, the first oven 13 may preferably maintain the temperature range of 90 to 130° C. The second elongation is preferably performed at an elongation ratio of 1.1:1 to 10:1. In the first oven 13, the removing of the solvent from the gel filament 22 and the elongation are preferably performed under an inert gas atmosphere, and pressure may be higher than atmospheric pressure so as to prevent air and oxygen from being permeated. Here, the speed for removing the solvent and the elongation ratio of the gel filament 22 may be adjusted by temperature in the oven, residence time in the oven, or the entire length of the oven, and the gel filament 22 in which the process is completed is converted into the dry filament (solid fiber) 23.

The dry filament 23 formed in the process may be converted into the gel filament 24 by adding the first solvent for additional elongation. The process may be performed in a first solvent reactor 14. In order to remove the first solvent from the gel filament 24 passing through the first solvent reactor 14, a process of adding a second solvent may be performed in the second solvent reactor 15. Examples of the process of adding the second solvent may include without limitation at least any one method selected from a method of immersing the filament in a container containing the second solvent, a method of spraying the second solvent, and a method of flowing the second solvent being a gaseous fluid or a supercritical fluid under an inert gas atmosphere.

The gel filament 24 may be transferred to a second oven 13 and be elongated and oriented simultaneously with the removing of the second solvent while passing through the over and under rolls at a gradually increased speed, wherein the second oven may preferably maintain the temperature range of 90 to 130° C. In addition, the elongation of the gel filament 24 in the second oven 16 is preferably performed at an elongation ratio of 1.1:1 to 10:1. Further, in the second oven 16, the removing of the solvent from the gel filament and the elongation are preferably performed under an inert gas atmosphere, and pressure may be higher than atmospheric pressure so as to prevent air and oxygen from being permeated. Here, the speed for removing the solvent and the elongation ratio of the gel filament 24 may be adjusted by temperature in the oven, residence time in the oven, or the entire length of the oven, and the gel filament 24 in which the process is completed is converted into the dry filament.

The converted dry filament which is fabricated and finally obtained by the fabrication method according to the present invention may have 80 to 95% of a degree of crystallization, and 1 to 10 of a dichroic ratio.

Hereinafter, Examples will be provided in order to describe the present invention in more detail. However, the present invention is not limited to Examples below.

Example 1

(i) A mixed liquid containing 95 wt % of an ultra high molecular weight polyethylene (UHMWPE, weight average molecular weight: 4 million g/mol, absolute viscosity: 20 dl/g) and 5 wt % of toluene was stirred at 135° C. for 30 minutes. The mixed liquid was spinned by a spinneret having a L/D ratio of 25:1 by using a twin screw extruder at 130° C. to form a solution filament. The solution filament was primarily elongated at a ratio of 5:1 (five times) (primary elongation), followed by precipitation in a water bath at 30° C. and cooling to form a gel filament.

(ii) The gel filament was secondarily elongated at a ratio of 20:1 (20 times) while being transferred before reaching a first oven process. Then, the gel filament was subjected to tertiary elongation at a ratio of 5:1 (5 times) while removing toluene (the first solvent) in the first oven (120° C.) to be converted into a dry filament.

(iii) In order to further elongate the dry filament, the dry filament was transferred to a first solvent reactor and immersed into toluene to be converted into a gel filament. In order to remove toluene remaining in the gel filament, the gel filament was transferred to a second solvent reactor and immersed into normal hexane, and then, transferred to a second oven. Next, the gel filament was subjected to quaternary elongation at a ratio of 5:1 (5 times) in the second oven (120° C.) to be converted into a dry filament.

Example 2

Example 2 was performed by the same method as Example 1 above except for using 1,2,4-trichlorobenzene instead of toluene in the first solvent reactor during process (iii) of Example 1.

Comparative Example 1

Comparative Example 1 was performed by the same method as Example 1 except that process (iii) of Example 1 was not performed.

A degree of crystallization and a degree of orientation of a polymer chain were analyzed in the dry filaments fabricated in Examples 1 and 2 and Comparative Example 1.

The degree of crystallization was measured based on an enthalpy value (291 J/g) of 100% UHMWPE crystal by DSC analysis, and the degree of orientation of the polymer chain was measured by IR analysis. In order to measure the degree of orientation, a dichroic ratio (absorbance when IR beam incident angle is parallel to a fiber axis/absorbance when IR beam incident angle is vertical to the fiber axis) was calculated by measuring absorbance when the IR beam incident angle is parallel to the fiber axis and absorbance when IR beam incident angle is vertical to the fiber axis. The degree of orientation of the polymer chain was determined by the dichroic ratio.

Figure 2:
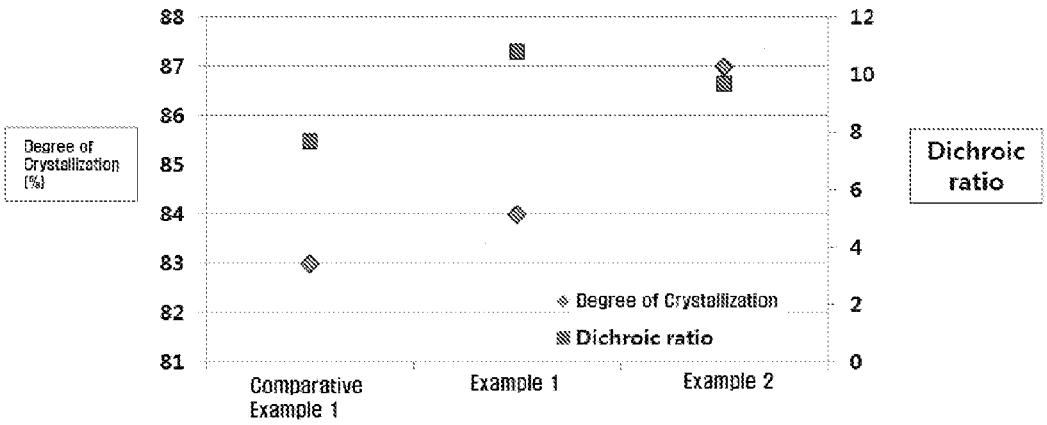
FIG. 2 shows a degree of crystallization of a thermal conductive polymer fiber and a degree of orientation of a polymer chain according to an exemplary embodiment of the present invention.

FIG. 2 shows the degree of crystallization of the thermal conductive polymer fiber and the degree of orientation of the polymer chain according to an exemplary embodiment of the present invention.

It could be appreciated from Examples 1 and 2 according to the present invention that the degree of crystallization and the degree of orientation of the chain were increased by performing of the additional elongation processes. Meanwhile, in Example 2, the degree of crystallization was significantly improved; and the orientation of the chain was slightly less improved due to interruption of the chain orientation depending on temperature at the time of elongation.

With the method of fabricating the thermal conductive polymer according to the present invention, thermal conductivity may be improved without adding the thermal conductive filler. In addition, since the process is simplified and production efficiency is excellent, productivity may be maximized to provide economical benefits.

Hereinabove, although the present invention is described by specific matters such as concrete components, and the like, exemplary embodiments, and drawings, they are provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to the above-described exemplary embodiments, and the following claims as well as all modified equally or equivalently to the claims are intended to fall within the scopes and spirits of the invention.

What is claimed is:

1. A method of fabricating a thermal conductive polymer, comprising:

a) fabricating a gel filament by primarily elongating a solution filament formed by spinning a mixed solution containing an ultra high molecular weight polyolefin (UHMWPO) resin and a first solvent, followed by cooling;

b) secondarily elongating the gel filament;

c) fabricating a dry filament by removing the solvent from the gel filament, followed by tertiary elongation; and d) converting the dry filament into the gel filament by adding the first solvent to the dry filament;

e) removing the first solvent from the converted gel filament; and f) quaternarily elongating the gel filament from which the first solvent is removed.

2. The method of claim 1, wherein the UHMWPO has a weight average molecular weight of 3,500,000 g/mol to 10,500,000 g/mol, and an absolute viscosity of 5 to 45 dl/g.

3. The method of claim 1, wherein the UHMWPO is an ultra high molecular weight polyethylene (UHMW PE).

4. The method of claim 1, wherein the mixed solution further contains any one or two or more highly crystalline resin(s) selected from the group consisting of polyethylene terephthalate (PET), polyoxymethylene (POM), nylon, polytetrafluoroethylene (PTFE) and polyphenylene sulfide (PPS).

5. The method of claim 1, wherein the first solvent is any one selected from the group consisting of a mineral oil, decalin, tetralin, xylene, toluene, dodecane, undecane, nonane, octene, polyethylene wax, and mixtures thereof.

6. The method of claim 1, wherein the mixed solution of a) is obtained by dissolving a mixture at 120 to 160° C., and the polyolefin has a concentration of 30 to 80 wt %.

7. The method of claim 1, wherein the cooling of a) is performed at a temperature range of 30 to 80.

8. The method of claim 1, wherein the primarily elongating of a) is performed at a ratio of 1.1:1 to 40:1.

9. The method of claim 1, wherein the tertiary elongation of c) is performed at a temperature range of 90 to 130.

10. The method of claim 1, wherein the tertiary elongation of c) is performed at a ratio of 1.1:1 to 40:1.

11. The method of claim 1, wherein a second solvent of e) is a hydrocarbon solvent having a boiling point of 40 to 80.

12. The method of claim 1, wherein the removing of the first solvent of e) is performed by adding a second solvent to the dry filament using at least any one method selected from a method of immersing the filament in a container containing the second solvent, a method of spraying the second solvent, and a method of flowing the second solvent being a gaseous fluid or a supercritical fluid under an inert gas atmosphere.

13. The method of claim 1, wherein the quaternarily elongating of f) is performed at a temperature range of 90 to 130.

14. The method of claim 1, wherein the quaternarily elongating of f) is performed at a ratio of 1.1:1 to 40:1.

15. A thermal conductive polymer fabricated by the method of claim 1.

16. A thermal conductive polymer fabricated by the method of claim 2.

17. A thermal conductive polymer fabricated by the method of claim 3.

18. The thermal conductive polymer of claim 15, wherein a degree of crystallization is 80 to 95%, and a dichroic ratio is 1 to 10.

19. The thermal conductive polymer of claim 16, wherein a degree of crystallization is 80 to 95%, and a dichroic ratio is 1 to 10.

20. The thermal conductive polymer of claim 17, wherein a degree of crystallization is 80 to 95%, and a dichroic ratio is 1 to 10.

* * * * *